US006889524B2

(12) United States Patent
O'Connor et al.

(10) Patent No.: US 6,889,524 B2
(45) Date of Patent: May 10, 2005

(54) PROCESS AND APPARATUS FOR CRYOGENIC SEPARATION OF GASES

(75) Inventors: Declan P. O'Connor, Chessington (GB); Rebecca J. Andrew, Thames Ditton (GB); Christopher Suggitt, Woking (GB); Paul Higginbotham, Guildford (GB)

(73) Assignee: Air Products and Chemicals, Inc., Allentown, PA (US)

( * ) Notice: Subject to any disclaimer, the term of this patent is extended or adjusted under 35 U.S.C. 154(b) by 0 days.

(21) Appl. No.: 10/630,609

(22) Filed: Jul. 30, 2003

(65) Prior Publication Data

US 2004/0035150 A1 Feb. 26, 2004

(51) Int. Cl.[7] ..... F25J 3/00
(52) U.S. Cl. ..... 62/656; 62/50.2; 62/654
(58) Field of Search ..... 62/656, 654, 648, 62/643, 657, 50.2

(56) References Cited

U.S. PATENT DOCUMENTS

| | | | | |
|---|---|---|---|---|
| 3,059,439 A | * | 10/1962 | Rice et al. | 62/654 |
| 5,082,482 A | * | 1/1992 | Darredeau | 62/646 |
| 5,505,052 A | | 4/1996 | Ekins et al. | |
| 5,526,647 A | | 6/1996 | Grenier | |
| 5,566,556 A | * | 10/1996 | Ekins et al. | 62/654 |
| 5,941,098 A | * | 8/1999 | Guillard et al. | 62/656 |
| 6,038,885 A | * | 3/2000 | Corduan et al. | 62/653 |
| 6,062,044 A | * | 5/2000 | Bernard et al. | 62/654 |
| 6,134,916 A | * | 10/2000 | Jahnke | 62/648 |
| 6,272,884 B1 | * | 8/2001 | Billingham et al. | 62/656 |
| 6,357,259 B1 | * | 3/2002 | Higginbotham et al. | 62/656 |

FOREIGN PATENT DOCUMENTS

| | | | |
|---|---|---|---|
| EP | 0 556 861 A | 8/1993 | |
| EP | WO 99/40304 A | 8/1999 | |
| WO | 9940304 | 12/1999 | F02B/43/00 |

* cited by examiner

*Primary Examiner*—William C. Doerrler
(74) *Attorney, Agent, or Firm*—Willard Jones, II

(57) ABSTRACT

A back-up quantity of a "first" gas is supplied temporarily to maintain the level of production of the first gas from a cryogenic separation of a gaseous mixture comprising the first gas and at least one other gas in the event of reduction in the level of production of said first gas from the separation. In the event of reduction in the level of production of said first gas from the separation, liquefied first gas inventory is withdrawn from the or at least one of said cryogenic distillation systems and vaporised to produce said back-up quantity of first gas. The invention has particular application to the production of gaseous oxygen ("GOX") from the separation of air.

15 Claims, 1 Drawing Sheet

PROCESS AND APPARATUS FOR CRYOGENIC SEPARATION OF GASES

BACKGROUND OF THE INVENTION

The present invention relates to cryogenic separation of gases and, in particular, to a process and apparatus for the temporary supply of a back-up quantity of a "first" gas to maintain the level of production of the first gas from a cryogenic separation of a gaseous mixture comprising the first gas and at least one other gas in the event of reduction in the level of production of said first gas from the separation. The invention has particular application to the production of gaseous oxygen ("GOX") from the cryogenic separation of air.

GOX may be produced in a cryogenic air separation unit ("ASU"). Such an ASU may be integrated with a downstream process that utilises the GOX in some way. For example, the GOX may be used in the production of synthesis gas ("syngas") which is a mixture of hydrogen and carbon monoxide and which may be used in the preparation of higher molecular weight hydrocarbon compounds and/or oxygenates. A suitable example of a process to produce hydrocarbons would be the Fischer-Tropsch process. More than one ASU may be linked in parallel to produce GOX for the downstream process.

Some downstream processes, e.g. syngas production, gasification processes and ethylene oxide production, require a substantially constant level of production of GOX, that is the pressure or flow of the GOX must be maintained to within a narrow range. These processes are often referred to as "oxygen-critical processes". Thus, back-up systems must be in place to ensure the constant supply of GOX in the event of a reduction in the pressure or flow of the GOX product for whatever reason. In this connection, the pressure or flow of the GOX product may decrease because a component of the ASU fails suddenly. For example, the main air compressor, a booster air compressor (if present), an air pre-purifier, a liquid oxygen ("LOX") pump or a valve may fail.

It is well known to provide back-up GOX from a storage reservoir of high pressure ("HP") LOX. In the event the pressure or flow of the GOX product drops below a certain level, LOX may be taken from the reservoir and vaporised in a vaporiser to produce back-up GOX at the required customer pressure. It is also well known to provide back-up GOX from a storage reservoir of low pressure ("LP") LOX. In the event the pressure or flow of the GOX product drops below a certain level, LOX may be taken from the LP reservoir pumped to the desired pressure by one or more back-up LOX pumps and vaporised in a vaporiser to produce back-up GOX.

The back-up system is brought on line on receipt of a trigger signal, such as low product supply pressure. In the case of such a HP liquid back-up system, the trigger signal causes a vaporiser oxygen control valve to open. For the LP liquid back-up system, the trigger signal would also bring the, or each, back-up LOX pump to its design operating point. However, vaporisers cannot instantly attain their design vaporisation capacities when called upon to operate. The time taken to achieve that capacity depends on the type of vaporiser installed. Generally, ambient vaporisers have better response times than steam sparged water bath vaporisers due to relative inventories and unit masses. For example, a steam sparged water bath vaporiser must be kept warm so that it is ready for instantaneous use. Unfortunately, it is simply not possible initially to force LOX through the warm vaporiser at the design rate as the oxygen pressure drop through the vaporiser would be too high at warm standby conditions. The vaporiser needs time to cool down to a point where LOX may be vaporised at the necessary rate. This period of time may be up to 30 seconds within which time the oxygen-critical process may have been affected by the reduction in pressure or flow of GOX thereto.

It is well known to have a GOX buffer vessel in communication with the GOX output from the ASU(s) so that the GOX inventory of the line may be maintained high enough so that no unacceptable drop in line pressure occurs during the time taken for the vaporiser in the back-up system to come fully on-line. Such a buffer vessel may be at line pressure or may be pressurised, in which case a valve would have to used to reduce the pressure of the pressurised GOX before it would be released into the GOX product line. One drawback of using the buffer vessel is the capital cost involved.

WO-A-99/40304 (published on 12 Aug. 1999) comprises a combined cryogenic air separation unit/integrated gasifier combined cycle power generation system and describes a method for operating the ASU to vary its power consumption to maximise net power production during peak demand periods while maintaining peak efficiency when the power generation system operates at varying power production. The oxygen production rate is maintained at a stable optimum level throughout the day and is not subject to significant fluctuations during changes in power plant operating conditions. Referring to FIG. 1 of WO-A-99/40304, in periods of off-peak power demand, excess liquid oxygen generated by the ASU may be stored in the bottom of the low pressure distillation column 6 or transferred through line 13 to vessel 21 where it is stored until such time as it is needed during periods of high power demand in the integrated gasifier combined cycle system.

U.S. Pat. No. 6,062,044 (published on 16 May 2000) discloses the use of a liquid oxygen storage tank to store excess liquid oxygen which can be used to satisfy increases in oxygen demand.

It is an objective of the present invention to provide an alternative system for providing a back-up quantity of a first gas without having to use one or more expensive buffer vessels or at least to allow the capacity of such buffer volume to be substantially reduced. There is always an "inventory" (or store) of liquefied first gas in the cryogenic separation system, usually in the sump of a distillation column. The size of the inventory will depend on the size of the cryogenic distillation system but there is usually more than enough liquefied first gas stored in the distillation system itself to satisfy demand for the first gas during the time taken for the vaporiser in the main back-up system to fully come on-line. The inventors have devised a way of using this source of liquefied first gas to produce a back-up quantity of first gas and maintain the level of production of the first gas.

BRIEF SUMMARY OF THE INVENTION

According to the present invention, there is provided a process for the temporary supply of a back-up quantity of a "first" gas to maintain the level of production of the first gas from a cryogenic separation of a gaseous mixture comprising the first gas and at least one other gas in the event of reduction in the level of production of said first gas from the separation, said separation comprising:

separating the mixture, or a mixture derived therefrom, in at least one cryogenic distillation system to produce liquefied first gas, the or each system retaining a portion of said liquefied first gas as inventory; and vaporising a further portion of said liquefied first gas by indirect heat exchange against a process stream in at least one heat exchanger to produce said first gas; said process comprising, in the event of reduction in the level of production of said first gas from the separation, withdrawing liquefied first gas inventory from the or at least one of said cryogenic distillation systems and vaporising the withdrawn liquefied first gas inventory to produce said back-up quantity of first gas.

The inventory is initially withdrawn at a high enough rate to meet an acceptable level of demand for the first gas; preferably at substantially the same rate at which liquefied first gas is withdrawn when the distillation system is operational. However, over the period of backup, the rate usually will continuously decrease.

One advantage of the invention is that expensive buffer vessels are either no longer required or can be substantially reduced in volume, thereby enabling a significant saving to be made to the overall capital expenditure for such processes.

The process operates usually when the or at least one of the cryogenic distillation systems ceases to produce liquefied first gas (or "trips") but the process may be applied in other circumstances, for example if a leak develops in one of the process lines.

At least a portion of the vaporisation duty required to vaporise the withdrawn liquefied first gas inventory is preferably provided by heat inventory, i.e. stored heat, from the or at least one of the heat exchangers. There is a temperature gradient between the "warm" end and the "cold" end of the or each heat exchanger. Heat stored in the metal of a heat exchanger may be used to vaporise liquefied first gas inventory. It is clearly not desirable for the heat exchanger to cool down to such an extent that excessively cold first gas leaves the heat exchanger. However, the Inventors have calculated that there is more than enough heat in the metal of the heat exchanger to vaporise the withdrawn liquefied first gas inventory for the period of time necessary for the vaporiser to come fully on-line.

In an embodiment of the process involving one cryogenic distillation system which ceases to produce liquefied first gas, the process comprises withdrawing liquefied first gas inventory from the cryogenic distillation system and vaporising the withdrawn liquefied first gas inventory to produce said back-up quantity of first gas.

In another embodiment of the process involving more than one cryogenic distillation system and one of the cryogenic distillation systems ceases to produce liquefied first gas, the process comprises withdrawing liquefied first gas inventory from the cryogenic distillation system in which liquefied first gas production has ceased and vaporising the withdrawn liquefied first gas inventory to produce the back-up quantity of first gas.

In an alternative, and presently preferred, arrangement of the embodiment involving more than one cryogenic distillation system and one of the cryogenic distillation systems ceases to produce liquefied first gas, the process comprises withdrawing liquefied first gas inventory from the or each cryogenic distillation system in which liquefied first gas production has not ceased and vaporising the withdrawn liquefied first gas inventory to produce said back-up quantity of first gas. The rate at which the liquefied first gas is withdrawn from the remaining (operational) distillation systems is increased to accommodate the lack of contribution to the first gas product stream from the failed distillation system. For example, in an embodiment having two cryogenic distillation systems in parallel, one of which fails, the remaining operational distillation system would produce first gas at up to 100% over the normal operational rate, usually only for the short period of time until the vaporiser of the back-up system comes fully on-line. In an embodiment having three cryogenic distillation systems in parallel, one of which fails, the remaining operational distillation systems would usually each produce first gas at up to 50% over the normal operational rate for one distillation system. Again, the increase in rate would usually only be for the short period of time until the vaporiser of the back-up system comes fully on-line.

In this alternative arrangement, for each cryogenic distillation system, the separation may further comprise:

compressing said mixture to produce compressed mixture;

dividing said compressed mixture or a mixture derived therefrom into at least two portions;

cooling a first portion of said compressed mixture by indirect heat exchange in a heat exchanger and feeding the resultant cooled first portion to the cryogenic distillation system for separation;

further compressing a second portion of said compressed mixture in a booster compressor to produce further compressed mixture; and cooling and condensing said further compressed mixture by indirect heat exchange in the, or a further, heat exchanger and feeding the resultant cooled and condensed further compressed mixture to the cryogenic distillation system for separation. In such an embodiment, the booster compressor may well operate at below its maximum operational rate. In such circumstances, the process may further comprise, in the event of one of the cryogenic distillation systems ceasing to produce liquefied first gas, increasing the flow of the second portion through the booster compressor of the, or each, remaining cryogenic distillation system such that the resultant increased flow of further compressed mixture through said the, or further, heat exchanger of the, or each, remaining cryogenic distillation system provides a portion of the vaporisation duty required to vaporise the withdrawn liquefied first gas inventory to provide said back-up quantity of first gas.

Preferably, the process is initiated automatically when the or at least one cryogenic distillation system ceases to produce liquefied first gas. In this way, the time taken for the process to be up and running is likely to be significantly less that if the process were to be initiated manually although it is to be understood that such manual initiation is also within the scope of the present invention.

In preferred embodiments, there is a back-up quantity of liquefied first gas stored ready for vaporisation in at least one vaporiser to produce first gas in the event of reduction in the level of production of said first gas from the separation. In such embodiments, the process operates only during the period of time required for the or each vaporiser to come on-line, i.e. to cool down sufficiently for liquefied first gas to be vaporised at the rate necessary to maintain the required output pressure or flow of first gas product.

The entire back-up system (liquid storage, pumps (if present), vaporizer, etc.) could be eliminated, or greatly reduced in size, by use of another embodiment of the invention. In general, if there are multiple ASUs then there will often be multiple downstream processing units. If one of the ASUs were to trip then one of the downstream processing units could be shutdown. It would not be necessary to go to the substantial capital cost of liquid storage and vaporization facilities, to keep the unit supplied with gas from the ASU. However, typically it would take a significant time, e.g. 10 to 30 minutes, for one of the downstream processing units to correctly and safely reduce capacity and shutdown. During this period, the unit must continue to be supplied with gas from the ASU, albeit at a reducing capacity.

In this period, the pressurised LOX flow in the untripped ASUs could be increased to substantially higher than the maximum steady state flow by static head increase or pumping. The extra pressurised LOX flow would temporarily reduce liquid inventory levels in the ASUs. The additional flow would be vaporized in the ASU main exchangers by utilizing the thermal inventory of the main exchanger metal along with any spare capacity in the untripped ASUs. Although such a situation could only continue for a relatively short period before the oxygen product left the ASU at an excessively cold temperature, the situation only is required to continue for the short period it takes to unload and shutdown one of the downstream processing units. Thus, it is proposed that at least a portion of the back-up quantity of gas could be supplied from the untripped ASUs for the duration of the shutdown period.

Alternatively, the capacity of one of more of the downstream units could be reduced. However, it may take as much as 10 to 30 minutes to achieve the turndown and during that period the total oxygen demand may be larger than the maximum continuous capacity of the online ASUs.

The process has particular application to cryogenic separations of air in which the gaseous mixture is air and the first gas is argon, nitrogen or, especially, oxygen. However, the invention has application in other cryogenic separations of gaseous mixtures in which a liquid product is separated within a coldbox and then vaporised within the coldbox to exit as a product gas. Examples of such separations include the separation of a mixture of carbon monoxide (CO) and methane; the separation of nitrogen from methane in a nitrogen rejection unit, in which a bottoms methane rich stream is vaporised in a main exchanger against a condensing (unboosted) feed stream; and the separation of nitrogen from CO in a hydrogen/carbon monoxide ("HYCO") plant in which there is a separation column to separate nitrogen from CO resulting in the CO being produced as a liquid, which is vaporised in the main exchanger.

DETAILED DESCRIPTION OF THE INVENTION

Figure 1:
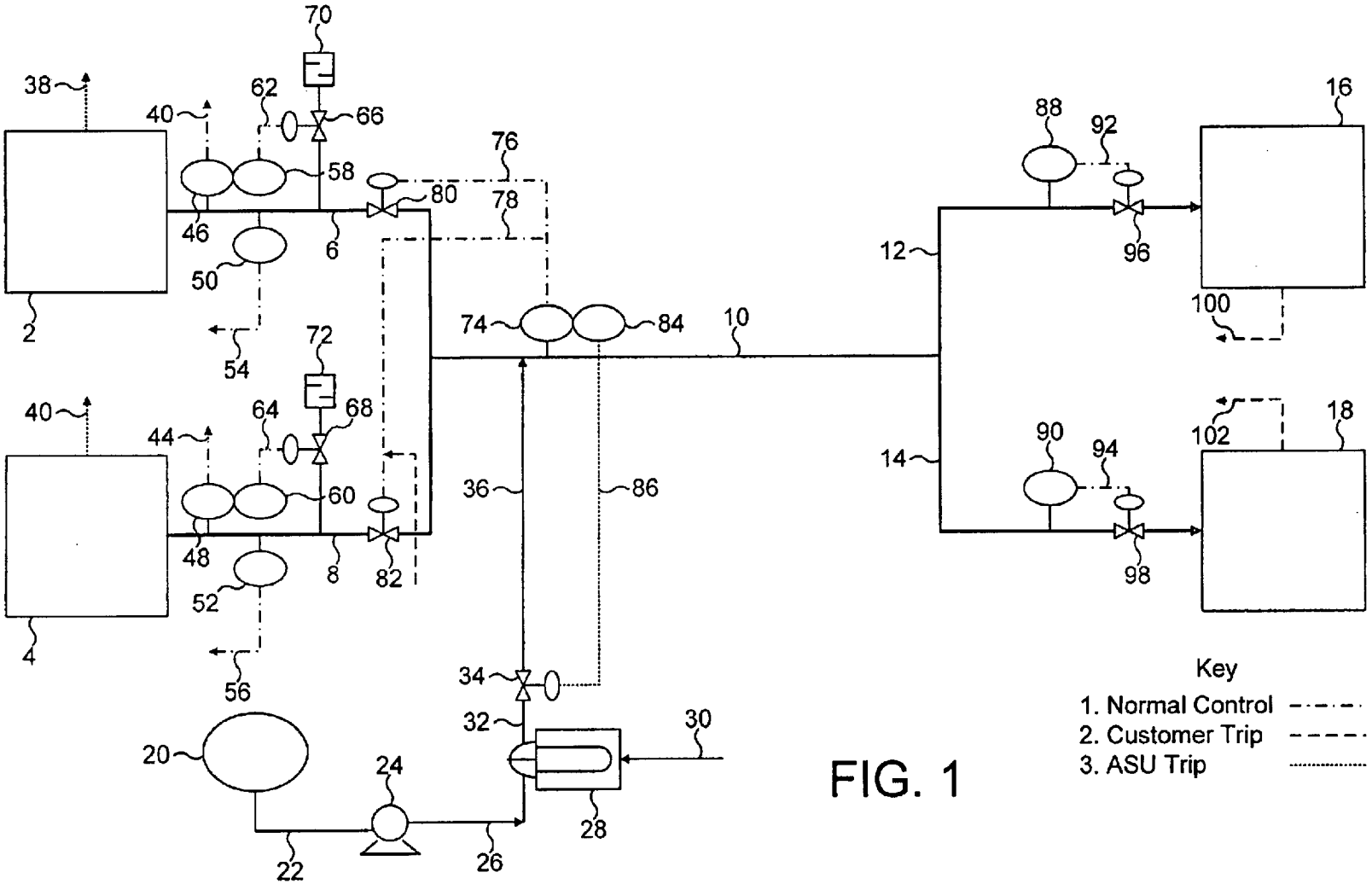
FIG. 1 is a general schematic representation of an embodiment of the present invention as applied to the production of GOX from two ASUs arranged in parallel for use in the production of syngas.

Referring to FIG. 1, GOX is produced in two ASUs 2, 4. The first ASU 2 produces a stream 6 of GOX, which is combined with a stream 8 of GOX from the second ASU 4. The combined stream 10 is divided into two portions 12,14, the first portion 12 being fed to a first syngas generation unit 16 and the second portion 14 being fed to a second syngas generation unit 18.

A back-up system is provided to produce back-up GOX in the event of a reduction in the pressure or flow of GOX in stream 10. Back-up GOX is produced by the vaporisation of LOX stored in a LOX storage vessel 20. When required, LOX is withdrawn from the storage vessel as stream 22 and pumped in a pump 24 to produce a pumped LOX stream 26. The pumped LOX stream 26 is fed to a steam sparged water bath vaporiser 28, which is fed by a stream 30 of steam. A newly vaporised GOX stream 32 is fed via pressure control valve 34 as stream 36 to GOX stream 10. However, pump 24 would not be required if the LOX storage vessel 20 operates at an appropriate high pressure.

The back-up system is brought on-line by a control system. In normal operation flow controllers 46, 48 monitor the oxygen produced from the ASUs 2, 4 and send control signals 42, 44 to adjust the airflow to ASUs 2, 4 to match the oxygen demand of the customer.

In the event that the customer oxygen demand drops below the minimum capacity of the ASUs 2, 4, flow controllers 60, 62 send control signals 62, 64 to open GOX vent valves 66, 68 and vent the excess GOX production to atmosphere via vent silencers 70, 72.

Pressure sensors 50, 52 monitor the pressure of GOX in streams 6, 8 respectively. If the pressure of GOX through one of the GOX product streams 6, 8 drops, a control signal 54, 56 is sent to ASUs 2, 4 to increase the pressure of the LOX withdrawn from the distillation system. If this pressure increase is achieved by use of LOX pumps within units 2, 4, control signal 54, 56 adjusts the output of the pump. If the pressure increase is achieved by static head increase of the LOX within ASUs 2, 4, control signal 54, 56 adjusts a control valve in the LOX line exiting the distillation system.

Pressure controller 74 monitors the pressure of GOX in stream 10. If the pressure of GOX in stream 10 drops, a control signal 76, 78 is sent to control valves 80, 82 so that the flow of GOX to stream 10 can be adjusted. Pressure controller 84 also monitors the pressure of GOX in stream 10. The pressure setpoint of controller 84 is lower than that of controller 74. If the pressure drops below the setpoint of controller 84, a control signal 86 is sent to valve 34, which opens to permit GOX from the vaporisation 28 of stored LOX to enter stream 10 and maintain the pressure of GOX in stream 10.

Flow controllers 88, 90 monitor flow of GOX in streams 12,14 respectively. If the flow of GOX differs from the setpoint of controllers 88,90, a control signal 92, 94 is sent to flow control valves 96, 98 which would adjust the GOX flow accordingly. The setpoint of flow controllers 88, 90 is determined by the control system of syngas generation unit 16, 18. In the event of failure of one of the syngas generation units, a trip signal 100,102 would be sent to the ASUs 2, 4 to initiate a shutdown of one of the ASUs.

In the event that one of the ASUs 2, 4 trips and ceases to produce LOX, a trip signal 38, 40 is sent to the back-up system. The trip signal would immediately bring backup pump 24 to its design operating point and would open backup control valve 34 to a preset position before surrendering control of the valve to pressure controller 84.

In the event that one of the ASUs 2, 4 should trip and cease to produce GOX, in one embodiment, a trip signal (not shown) would be sent to a secondary LOX pump (not shown) of the ASU still operating which is normally kept at a cryogenic temperature. The secondary pump would then begin to pump LOX inventory from the distillation system (not shown) which would increase the flow of LOX through the heat exchanger (not shown) thereby increasing the amount of GOX produced by the ASU at least until the vaporiser 28 of the back-up system is fully on-line. In another embodiment, a trip signal (not shown) would be sent to an oversized LOX pump in the ASU still operating instructing the pump to pump more LOX inventory from the distillation system through the heat exchanger to produce more GOX, again at least until the vaporiser 28 of the back-up system is fully on-line.

Whilst the present process has been discussed with particular reference to the production of oxygen from an air separation process, it is to be understood that the process can be applied to the production of any gas using cryogenic separation processes, such as those previously identified.

It will be appreciated that the invention is not restricted to the details described above with reference to the preferred embodiments but that numerous modifications and variations can be made without departing from the spirit and scope of the invention as defined in the following claims.

What is claimed is:

1. A process for the temporary supply of a back-up quantity of a "first" gas, during the time taken for a vaporizer in a main back-up system to come fully on-line, maintain the level of production of the first gas from a cryogenic separation of a gaseous mixture comprising the first gas and at least one other gas in the event of reduction in the level of production of said first gas from the separation, said separation comprising:

separating the mixture, or a mixture derived therefrom, in at least one cryogenic distillation system to produce liquefied first gas, the or each system retaining a portion of said liquefied first gas as inventory; and vaporizing further portion of said liquefied first gas by indirect heat exchange against a process stream in at least one heat exchanger to produce said first gas;

said process comprising, in the event of reduction in the level of production of said first gas from the separation, withdrawing liquefied first gas inventory from the or at least one of said cryogenic distillation systems and vaporizing the withdrawn liquefied first gas inventory to produce said back-up quantity of first gas, wherein at least a portion of the vaporization duty required to vaporize said withdrawn liquefied first gas inventory is provided by heat inventory from the or at least one of said heat exchangers.

2. The process according to claim 1 wherein the process operates when the or at least one of the cryogenic distillation systems ceases to produce liquefied first gas.

3. The process according to claim 1 wherein there is one cryogenic distillation system and said system ceases to produce liquefied first gas, said process comprising withdrawing liquefied first gas inventory from said cryogenic distillation system and vaporizing the withdrawn liquefied first gas inventory to produce said back-up quantity of first gas.

4. The process according to claim 1 wherein there is more than one cryogenic distillation system and one of said cryogenic distillation systems ceases to produce liquefied first gas, said process comprising withdrawing liquefied first gas inventory from the cryogenic distillation system in which liquefied first gas production has ceased and vaporizing the withdrawn liquefied first gas inventory to produce said back-up quantity of first gas.

5. The process according to claim 1 wherein there is more than one cryogenic distillation system and one of said cryogenic distillation systems ceases to produce liquefied first gas, said process comprising withdrawing liquefied first gas inventory from the or each cryogenic distillation system in which liquefied first gas production has not ceased and vaporizing the withdrawn liquefied first gas inventory to produce said back-up quantity of first gas.

6. The process according to claim 5 wherein, for each cryogenic distillation system, said separation further comprises:

compressing said mixture to produce compressed mixture;

dividing said compressed mixture or a mixture derived therefrom into at least two portions;

cooling a first portion by indirect heat exchange in a heat exchanger and feeding the resultant cooled first portion to the cryogenic distillation system for separation;

further compressing a second portion in a booster compressor to produce further compressed mixture; and cooling and condensing said further compressed mixture by indirect heat exchange in the or a further heat exchanger and feeding the resultant cooled and condensed further compressed mixture to the cryogenic distillation system for separation, said process further comprising, in the event of one of said cryogenic distillation systems ceasing to produce liquefied first gas, increasing the flow of the second portion through the booster compressor of the or each remaining cryogenic distillation system such that the resultant increased flow of further compressed mixture through said the or further heat exchanger of the or each remaining cryogenic distillation system provides a portion of the vaporization duty required to vaporize said withdrawn liquefied first gas inventory to provide said back-up quantity of first gas.

7. The process according to claim 1 wherein the process is initiated automatically when the or at least one cryogenic distillation system ceases to produce liquefied first gas.

8. The process according to claim 1 wherein liquefied first gas is stored for vaporization in at least one vaporizer to produce back-up first gas in the event of reduction in the level of production of said first gas from the separation, said process operating only during the period of time required for the or each vaporizer to come on-line.

9. The process according to claim 1 wherein the first gas is produced in more than one cryogenic distillation system and is supplied to more than one downstream processing unit, said process being operated only during the period of time required to turndown or shutdown one of the downstream processing units in the event that one of the distillation systems ceases to produce liquefied first gas.

10. The process according to claim 1 wherein the gaseous mixture is air and the first gas is one of oxygen, nitrogen or argon.

11. The process according to claim 10 wherein the gaseous mixture is air and the first gas is oxygen.

12. A process for the temporary supply of a back-up quantity of a "first" gas, during the time taken for a vaporizer in a main back-up system to come fully on-line, to maintain the level of production of the first gas from a cryogenic separation of a gaseous mixture comprising the first gas and at least one other gas in the event of reduction in the level of production of said first gas from the separation, said separation comprising:

separating the mixture, or a mixture derived therefrom, in one cryogenic distillation system to produce liquefied first gas, the cryogenic distillation system retaining a portion of said liquefied first gas as inventory; and vaporizing further portion of said liquefied first gas by indirect heat exchange against a process stream in at least one heat exchanger to produce said first gas;

said process comprising, in the event of reduction in the level of production of said first gas from the separation due to said cryogenic distillation system ceasing to produce liquefied first gas, withdrawing liquefied first gas inventory from the cryogenic distillation system and vaporizing the withdrawn liquefied first gas, inventory to produce said back-up quantity of forst gas, wherein at least a portion of the vaporization duty required to vaporize said withdrawn liquefied first gas inventory is provided by heat inventory from the or at least one of said heat exchangers.

13. A process for the temporary supply of a back-up quantity of a "first" gas, during the time taken for a vaporizer in a main back-up system to come fully on-line, to maintain the level of production of the first gas from a cryogenic separation of a gaseous mixture comprising the first gas and at least one other gas in the event of reduction in the level of production of said first gas from the separation, said separation comprising:

separating the mixture, or a mixture derived therefrom, in more than one cryogenic distillation system to produce liquefied first gas, each system retaining a portion of said liquefied first gas as inventory; and vaporizing further portion of said liquefied first gas by indirect heat exchange against a process stream in at least one heat exchanger to produce said first gas;

said process comprising, in the event of reduction in the level of production of said first gas from the separation due to one of said cryogenic distillation systems ceasing to produce liquefied first gas, withdrawing liquefied first gas inventory from the cryogenic distillation system in which liquefied first gas production has ceased and vaporizing the withdrawn liquefied first gas inventory to produce said back-up quantity of first gas, wherein at least a portion of the vaporization duty required to vaporize said withdrawn liquefied first gas inventory is provided by heat inventory from the or at least one of said heat exchangers.

14. A process for the temporary supply of a back-up quantity of a "first" gas, during the time taken for a vaporizer in a main back-up system to come fully on-line, to maintain the level of production of the first gas from a cryogenic separation of a gaseous mixture comprising the first gas and at least one other gas in the event of reduction in the level of production of said first gas from the separation, said separation comprising:

separating the mixture, or a mixture derived therefrom, in more than one cryogenic distillation system to produce liquefied first gas, each system retaining a portion of said liquefied first gas as inventory; and vaporizing further portion of said liquefied first gas by indirect heat exchange against a process stream in at least one heat exchanger to produce said first gas;

said process comprising, in the event of reduction in the level of production of said first gas from the separation due to one of said cryogenic distillation systems ceasing to produce liquefied first gas, withdrawing liquefied first gas inventory from the or each one of said cryogenic distillation systems in which liquefied first gas production has not ceased and vaporizing the withdrawn liquefied first gas inventory to produce said back-up quantity of first gas, wherein at least a portion of the vaporization duty required to vaporize said withdrawn liquefied first gas inventory is provided by heat inventory from the or at least one of said heat exchangers.

15. The process according to claim 14 wherein the gaseous mixture is air and the first gas is oxygen.

* * * * *

UNITED STATES PATENT AND TRADEMARK OFFICE

CERTIFICATE OF CORRECTION

PATENT NO. : 6,889,524 B2 
DATED : May 10, 2005
INVENTOR(S) : O'Connor, Declan P. et al.

It is certified that error appears in the above-identified patent and that said Letters Patent is hereby corrected as shown below:

Column 7,
Line 19, add the word -- to -- after the words "fully on-line"

Column 9,
Line 4, change the word "forst" to -- first --

Signed and Sealed this

Twelfth Day of July, 2005

JON W. DUDAS
*Director of the United States Patent and Trademark Office*